US005327320A

United States Patent [19]

Fischer

[11] Patent Number: 5,327,320

[45] Date of Patent: Jul. 5, 1994

[54] APPARATUS FOR SUPPRESSION OF INDIVIDUAL IGNITION EVENTS IN AN IGNITION SYSTEM

[75] Inventor: Uwe Fischer, Schwaikheim, Fed. Rep. of Germany

[73] Assignee: Robert Bosch GmbH, Stuttgart, Fed. Rep. of Germany

[21] Appl. No.: 842,355

[22] PCT Filed: Feb. 27, 1991

[86] PCT No.: PCT/DE91/00159

§ 371 Date: Mar. 25, 1992

§ 102(e) Date: Mar. 25, 1992

[87] PCT Pub. No.: WO91/14866

PCT Pub. Date: Oct. 3, 1991

[30] Foreign Application Priority Data

Mar. 21, 1990 [DE] Fed. Rep. of Germany ..... 4009033

[51] Int. Cl.[5] ..... H01H 47/00

[52] U.S. Cl. ..... 361/152; 361/143; 361/153; 361/189

[58] Field of Search ..... 361/143, 152, 153, 160, 361/170, 189, 54, 55, 56, 91, 111; 324/378, 388, 392, 393, 397

[56] References Cited

U.S. PATENT DOCUMENTS

| | | | |
|---|---|---|---|
| 3,543,572 | 12/1970 | Summerer et al. . | |
| 3,940,977 | 3/1976 | Voross et al. . | |
| 3,985,109 | 10/1976 | Kondo et al. . | |
| 4,079,310 | 3/1978 | Ortmann | 324/397 |
| 4,672,941 | 6/1987 | Yamagata . | |
| 4,673,883 | 6/1987 | Wheeler et al. . | |
| 5,089,804 | 2/1992 | Mimura | 340/453 |

FOREIGN PATENT DOCUMENTS

| | | |
|---|---|---|
| 2443403 | 3/1976 | Fed. Rep. of Germany . |
| 3402537 | 8/1985 | Fed. Rep. of Germany . |
| 2377534 | 8/1978 | France . |
| 0897651 | 5/1962 | United Kingdom . |
| 1502094 | 2/1978 | United Kingdom . |
| 215172A | 2/1984 | United Kingdom . |

*Primary Examiner*—Jeffrey A. Gaffin

*Attorney, Agent, or Firm*—Frishauf, Holtz, Goodman & Woodward

[57] ABSTRACT

An apparatus for suppression of individual ignition events in an ignition system includes a short-circuit switch, connected in parallel to the primary winding of the ignition coil. The short-circuit switch is controlled by a control switch. In order to avoid having to provide a separate power supply to furnish triggering energy to the control switch, this energy is derived from the energy stored in the ignition coil during a closing phase of the ignition switch. This requires fewer components than prior art circuits designed for the same purpose.

16 Claims, 1 Drawing Sheet

APPARATUS FOR SUPPRESSION OF INDIVIDUAL IGNITION EVENTS IN AN IGNITION SYSTEM

BACKGROUND OF THE INVENTION

The invention relates generally to apparatus for suppression of individual ignition events in an ignition system. An apparatus of this kind is known for instance from German Patent 24 43 403, Knoedler & Blum, assigned to Robert Bosch GmbH. The known circuit arrangement is used in ignition systems that have an ignition coil and an interruptor switch disposed in the primary circuit of the ignition coil. To suppress individual ignition events, a controllable switch is provided, which is connected parallel to the primary winding of the ignition coil. For triggering the switch, a trip switch device is provided, which draws its requisite triggering energy from a separate circuit, for instance in the form of a blocking oscillator. With the aid of the blocking oscillator, the necessary control voltage for the switch, which is above the operating low voltage of the ignition system, is simultaneously furnished.

The object of the invention is to simplify the known circuit arrangement for suppression of individual ignition events in an ignition system.

ADVANTAGES OF THE INVENTION

The apparatus according to the invention has the advantage that only a few components are needed. Production involves only low cost. Moreover, because of the low number of components, the operational reliability of the circuit rises. The ease of connection to the existing ignition system, since only two connections have to be made on the primary side of the ignition system, is especially advantageous. The simplification of the circuit arrangement is attained by providing that the control energy for actuating a short-circuit switch disposed on the primary side is furnished after the opening of an ignition switch, from the energy stored in the ignition coil during the closing phase of the ignition switch.

The connection of the electrically controllable short-circuit switch parallel to the primary winding of the ignition coil is advantageous. This provision keeps the load on the ignition coil low.

The actuation of the short-circuit switch is especially simple if a further electrically triggerable control switch, which is preferably in the form of a MOSFET, is provided between the primary-side connection of the ignition coil, to which the ignition switch is connected, and the control input of the short-circuit switch.

A triac, which is preferably located in an optical coupler, is especially suitable as the control switch. The optical coupler assures an electrical separation between the control circuit of the short-circuit switch and the external trigger circuit of the short-circuit switch.

When the control switch is closed, a diode located between the primary-side connection of the ignition coil, to which the ignition switch is connected, and the short-circuit switch keeps blocking-state voltages of predetermined polarity away from the control input of the short-circuit switch.

A thyristor is especially suitable as the short-circuit switch.

BRIEF FIGURE DESCRIPTION

FIG. 1 shows a first embodiment of the ignition-event suppression circuit of the present invention; and FIG. 2 shows a second embodiment of the invention, incorporating an optical emitter/coupler element.

DETAILED DESCRIPTION

Figure 1:
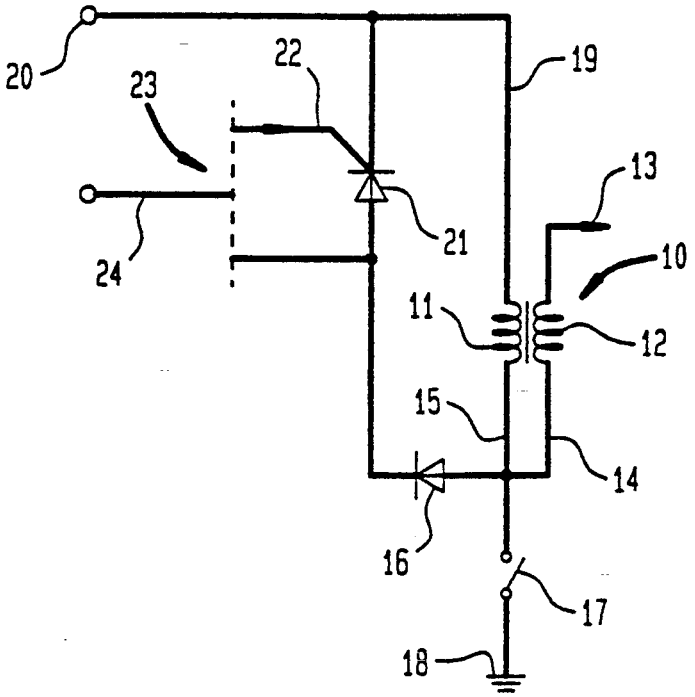

FIG. 1 shows an ignition coil 10, which includes at least one primary and at least one secondary winding 11, 12. The generated ignition voltage appears at a secondary winding connection 13. A second secondary winding connection 14 is connected to a first primary winding connection 15. A diode and an ignition switch 17 are connected to the first primary winding connection 15. The ignition switch 17 is connected to a ground 18. A second primary winding connection 19 of the ignition coil 10 leads to a power supply connection 20. A short-circuit switch 21 is connected between the diode 16 and the power supply connection 20. A control switch 23 is connected between the diode 16 and one control input 22 of the short-circuit switch 21. The control switch 23 has a control input 24 that leads to a trigger circuit, not shown in further detail in FIG. 1.

Figure 2:
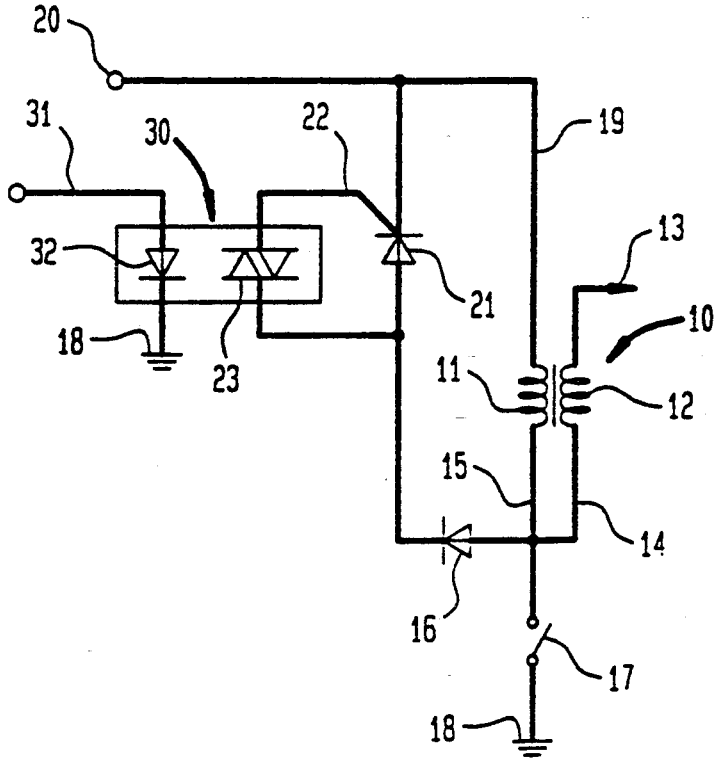

FIG. 2 shows another exemplary embodiment of the apparatus according to the invention. Elements shown in FIG. 2 and matching those of FIG. 1 have the same reference numerals in both drawings figures. The triggering of the short-circuit switch 21 differs from that in the apparatus of FIG. 1. The control switch 23 is located in an optical coupler 30, whose control input 31 leads to an optical element 32 that emits visible radiation.

The apparatus according to the invention will now be described in further detail, referring to FIGS. 1 and 2:

The ignition coil 10 is for instance provided in order to generate ignition pulses for an internal combustion engine. The secondary ignition voltage appears at the first secondary connection 13. From there, it travels either to a distributor or directly to one or more spark plugs. Neither a distributor nor spark plugs are shown in the drawings. An ignition pulse is tripped if the ignition switch 17 is opened after a closing phase. During the closing phase, magnetic energy is stored by means of the current flowing in the primary winding 11 of the ignition coil 10. After the opening of the ignition switch 17, the abrupt break in the flow of current causes a steep voltage increase in the primary winding 11 at the first primary winding connection 15, which is transmitted to the secondary side. If the ignition switch 17 is in the form of a mechanical interruptor or an end stage transistor of a transistor ignition system, then a capacitor must be connected parallel to the ignition switch. On the one hand, this capacitor limits the voltage amplitude; on the other, it leads to the development of an oscillation, which is damped in cooperation with the lost resistances of the circuit.

It may be necessary to suppress individual ignition events, for the sake of diagnosis in an engine. This is true, for instance, if the contributions of the various cylinders to the engine output are to be determined separately. To suppress individual ignition events, the short-circuit 21 is therefore provided, which prevents secondary ignition voltage pulses from appearing. For instance, at a predetermined instant, it short-circuits the primary winding 11 of the ignition coil 10.

The instant is defined by the trigger circuit, not shown, which is connected to the control input 24 of the control switch 23. This instant is preferably at the end of the closing phase of the ignition switch 17. At that time, the energy stored in the ignition coil 10 is at a maximum. This assures the furnishing of adequate control energy for actuating the short-circuit switch 21.

In principle, the control switch can be closed at any arbitrary instant before the ignition event that is to be suppressed. As long as the voltage at the primary winding connection 15 is less than the supply voltage, it remains out of operation.

After the opening of the ignition switch 17, a high primary-side voltage would arise at the first primary winding connection 15; transformed to the secondary side, it produces the ignition pulse. When the control switch is closed, the short-circuit switch 21 prevents the appearance of the primary-side high voltage and thus inhibits the ignition pulse.

The control switch can be opened again at any arbitrary time between the opening of the ignition switch 17 and the next ignition that is not to be suppressed. A high-voltage-proof transistor is for instance provided as the short-circuit switch. A thyristor is especially suitable; it is relatively economical under the prevailing conditions, in terms of electrical strength and peak current capacity. The imposition of a high voltage at a predeterminable polarity upon the control input of the short-circuit switch 21 is avoided with a diode 16 connected in series with the short-circuit switch 21 and located between the first primary winding connection 15 of the ignition coil 10 and the arrangement 21. In the exemplary embodiments shown in the drawings, the voltage components at the primary winding connection 15 that are negative relative to the power supply connection 20 are kept away from the short-circuit switch 21. A series-connected resistor that limits the maximum current can also be provided.

For triggering the short-circuit switch 21, a control switch 23 is provided, for instance in the form of a MOSFET of the self-inhibiting type. MOSFETs of this kind, which can handle the voltage rises that occur in the ignition system, can currently be obtained inexpensively. A control circuit, not shown in FIG. 1, outputs suitable trigger pulses, which lead to the suppression of the ignition voltage, to the control input 24 of the MOSFET. A complete electrical separation between the triggering and the control switch 23 is possible, for instance with an optical coupler 30 shown in FIG. 2. An optically triggerable thyristor can for instance be used as the short-circuit switch 21. A triac is also highly suitable for that purpose and is inexpensive; it can be used both in the exemplary embodiment of FIG. 1 and in the exemplary embodiment of FIG. 2. Optical couplers 30 having a triac 23, which withstand the high voltage rises that occur, are currently available. The triggering is effected via the control input 31, which leads to an optical element 32, preferably a light-emitting diode, located in the optical coupler 30.

I claim:

1. An apparatus for suppression of individual ignition events in an ignition system having at least one ignition coil (10), including a first primary winding connection (15) which is connected to a controllable ignition switch (17) and to an electrically controllable short-circuit switch (21) located on the primary side of the ignition coil (10), said short-circuit switch serving to suppress any primary-side high voltage occurring after opening of the controllable ignition switch (17), wherein control energy for actuation of the short-circuit switch (21) is furnished from electromagnetic energy stored in the ignition coil (10) during a closing phase of operation of the ignition switch (17).

2. The apparatus of claim 1, wherein the short-circuit switch (21) is connected parallel to a primary winding (11) of the ignition coil 910).

3. The apparatus of claim 2, further comprising (FIG. 2) a further, electrically triggerable control switch (23) connected between the first primary winding connection (15) of the ignition coil (10), to which the ignition switch (17) is connected, and a control input (22) of the short-circuit switch (21).

4. The apparatus of claim 3, wherein the control switch (23) is a MOSFET).

5. The apparatus of claim 4, wherein the short-circuit switch (21) is a thyristor.

6. The apparatus of claim 3, wherein the control switch (23) is a triac.

7. The apparatus of claim 6, wherein the short-circuit switch (22) is a thyristor.

8. The apparatus of claim 3, wherein an electrical separation is provided between the control switch (21) and its control input (24, 31).

9. The apparatus of claim 8, wherein the short-circuit switch (21) is a thyristor.

10. The apparatus of claim 3, wherein the control switch (23) is part of an optical coupler (30).

11. The apparatus of claim 10, wherein the short-circuit switch (21) is a thyristor.

12. The apparatus of claim 3, wherein the short-circuit switch (21) is a thyristor.

13. The apparatus of claim 2, wherein the short-circuit switch (21) is a thyristor.

14. The apparatus of claim 1, wherein a diode (16) is connected between the first primary winding connection (15) of the ignition coil (10) and the short-circuit switch (21).

15. The apparatus of claim 14, wherein the short-circuit switch (21) is a thyristor.

16. The apparatus of claim 1, wherein the short-circuit switch (21) is a thyristor.

* * * * *